US005788045A

United States Patent [19]

Stiefel et al.

[11] Patent Number: 5,788,045

[45] Date of Patent: Aug. 4, 1998

[54] EMPTY BOTTLE COLLECTOR

[75] Inventors: Richard Stiefel, Heimsheim; Hans-Hermann Trautwein, Ostfildern, both of Germany

[73] Assignee: Trautwein SB-Technik GmbH, Ostfildern, Germany

[21] Appl. No.: 676,183

[22] PCT Filed: Dec. 7, 1994

[86] PCT No.: PCT/EP94/04074

§ 371 Date: Jul. 3, 1996

§ 102(e) Date: Jul. 3, 1996

[87] PCT Pub. No.: WO95/19020

PCT Pub. Date: Jul. 13, 1995

[30] Foreign Application Priority Data

Jan. 7, 1994 [DE] Germany ..... 44 00 251.3

[51] Int. Cl.[6] ..... G07F 7/06

[52] U.S. Cl. ..... 194/212; 209/525

[58] Field of Search ..... 194/208, 209, 194/212, 213; 209/524, 525

[56] References Cited

U.S. PATENT DOCUMENTS 4,248,334 2/1981 Hanley et al. ..... 194/209

4,519,307 5/1985 La Barge et al. ..... 194/213

FOREIGN PATENT DOCUMENTS 567732 11/1993 European Pat. Off. ..... 194/213

3320266 12/1984 Germany ..... 194/212

*Primary Examiner*—F. J. Bartuska

*Attorney, Agent, or Firm*—Flynn, Thiel, Boutell & Tanis, P.C.

[57] ABSTRACT

The invention relates to an empty bottle collector with an intake chamber (14) for empty bottles (16) and a carriage (20) as an interchangeable store (22). To simplify operations when the interchangeable store (22) is being filled and emptied, the empty bottle store (22) is accessible from the stationary intake chamber (14) via a closable aperture (38) transverse to the intake aperture (11). In addition, there is a conveyor with a transverse slide (68) movable to and fro transversely to the intake direction through the intake chamber (14) towards the aperture (38). The bottles are sorted via a sensor slide (44) movable to and fro in the intake direction crossing the path of the transverse slide (68) in the region of the intake chamber and fitted with sensors (48) for contactlessly scanning the shape of the bottle.

29 Claims, 5 Drawing Sheets

EMPTY BOTTLE COLLECTOR

FIELD OF THE INVENTION

The invention relates to an empty bottle collector having a housing, at least one intake chamber for empty bottles accessible from outside through a closeable intake opening, an empty bottle store following the intake chamber, a feeding mechanism, which can be driven by a motor, for the transport of individual empty bottles from the intake chamber into the empty bottle store, a mechanism provided in the area of the intake chamber for recognizing the bottles, and a control mechanism preferably reacting to outputs signals of the bottle-recognizing mechanism for controlling the feeding mechanism and, if desired, a ticket output, whereby the intake chamber has a placement surface for receiving an upright positioned empty bottle and the empty bottle store has a store floor at the level of the placement surface for receiving upright positioned empty bottles.

BACKGROUND OF THE INVENTION

In a conventional empty bottle collector of this type (EP-A2-567 732), the empty bottles are fed at various planes through separately loadable intake chambers into stationary store compartments. Each intake chamber has a separate bottle-recognizing mechanism, with which the contour of the inserted empty bottle is scanned by mechanical scanning members within the intake chamber. The scanning is done with the help of a path indicator reacting to the movement of a sliding door, whereby a counter loaded with the output signals of the path indicator and storage means for storing of readings of the counter in the form of a value group defining the contour and size of the scanned empty bottle are provided. The scanning members are arranged on the sliding door and engage the intake chamber in order to trigger the path-measuring, counting and storing operations. The empty bottles are transported, after they have been scanned, with the help of a turnstile provided in the intake chamber through a bent feed channel into the empty bottle store. As soon as the store is full, it must be emptied right then and thereby individually removing the bottles.

To avoid this disadvantage, it is actually known in an empty bottle collector (DE-C-33 20 266) to arrange the empty bottle store in a carriage, which can be moved into a store chamber of the housing. The empty bottle store has therein a store floor elevationally movable in the carriage by a chain drive, the height of which floor can be adjusted by the uppermost bottle in the bottle store contacting a limit switch. The bottles are inserted into the intake chamber in a lying position and are placed by a receiving rotor onto a bottle pyramid forming on the store floor. The automatic adjustment of the floor height avoids glass breaks when the bottles hit the bottle pyramid. As soon as the movable bottle store is full, it is exchanged with an empty store. However, because of the lying bottle reception there exists the danger that residual fluid can run out of the bottles and can result in contamination of the bottle store. In addition, the random position of the bottles in the bottle store requires, during the removal and subsequent sorting, a considerable amount of work.

SUMMARY OF THE INVENTION

Starting out from this the basic purpose of the invention is to develop an empty bottle collector of the above-identified type, which enables an easy handling during loading and unloading and which, in spite of a high intake frequency, guarantees a reliable bottle recognition.

The basic idea behind the solution of the invention is that with a small path of movement between the intake chamber and the empty bottle store on a movement path, which is as rectilinear as possible, and with a contactless scanning of the bottle contour particularly short intake durations can be achieved. In order to accomplish this, it is suggested according to the invention that the empty bottle store be accessible from the stationary intake chamber through a closeable aperture aligned transversely with respect to the intake opening, and that the feeding mechanism has a transverse slide, which can be moved back and forth along a linear path of movement in the direction of the aperture transversely with respect to the intake direction through the intake chamber transporting the inserted empty bottle. The bottle-recognizing mechanism has in, a first alternative of the invention, a sensor slide, which can be moved back and forth linearly in the intake direction within the housing and crosses the path of movement of the transverse slide in the area of the intake chamber, and which sensor slide is equipped with sensors for the contactless scanning of the contour of the bottle and/or of the diameter of the bottle.

With these measures it is achieved that the measuring occurs with the empty bottle being in a rest position by moving the sensor slide so that the empty bottle, which stands loosely on the placement surface, is not subjected to any vibrations during the measuring operation, which vibrations could adulterate the measurement. Since the sensor slide with its contactless operating sensors can be quickly moved passed the bottle on the measuring path, a relatively short measuring time is obtained. The sensor slide is at the end of the measuring motion moved out of the path of movement of the transverse slide so that the empty bottle, after the bottle has been recognized, can be moved out of the intake chamber through the later aperture into the empty bottle store, prior to the sensor slide being able to be returned again into its initial position. After the transverse slide has been pulled back and the intake chamber can be released for a renewed bottle intake.

In order to prevent, when the intake chamber is open and with a simple means, a penetration into the empty bottle store through the aperture, it is suggested according to an advantageous embodiment of the invention that the sensor slide has a lateral arm, which is at the same time designed as a closure door for the aperture. Either receiving and transmitting elements or reflecting mirrors of the sensors designed as light barriers can be provided in this arm. A further advantageous development of the invention provides that the sensor slide have a second arm preferably carrying the sensors on the side of the intake chamber, which side is opposite the closure door arm. The second arm can thereby be arranged covered by a housing-fixed lateral boundary wall of the intake chamber, whereby the lateral boundary wall can have sensor shields elongated in the direction of movement of the sensor slide.

In order to further shorten the intake and recognition time for the empty bottles, it is suggested according to a further advantageous development of the invention that the lateral housing-fixed boundary wall and/or the sensor slide arm opposite the closure door have a recess for passage of the transverse slide in the lower area adjacent to the placement surface. In this case, it is possible for the transverse slide to form with its front surface in its end position moved back with respect to the aperture the lower part of a lateral boundary wall of the intake chamber. Furthermore, it is possible to already again move the sensor slide back into its initial position before the transverse slide, after the transverse transport has taken place, arrives again to its moved-back end position.

The sensors are advantageously designed as optoelectronic scanning members, preferably as reflecting or transmitted light barriers. When the drive of the sensor slide is coupled with a distance sensor triggered by the scanning members in order to recognize the bottles, an exact positioning of the empty bottles within the intake chamber is not important for a reliable bottle recognition.

The bottle-recognizing mechanism has, in a second alternative of the invention, in the area of the path of movement of the transverse slide between intake chamber and aperture, sensors arranged fixed on the housing for the contactless bottle scanning and a distance sensor coupled with the transverse slide or its drive and triggered by the sensors for detecting the contour of the bottle and/or of the diameter of the bottle. A sensor slide, as provided in the first alternative of the invention, is hereby not needed.

A particularly simple embodiment with respect to the design provides that the empty bottle, which is placed onto the housing-fixed placement surface, is detected by the motor-driven transverse slide and is moved on the path of movement through the sensor arrangement into the empty bottle store. Bottles, which do not get a refund, are in this case also moved into the empty bottle store since the bottle recognition occurs during the moving out of the empty bottle into the empty bottle store. In order to enable in this solution, a modification for rejection of bottles, which do not get a refund, additional measures must be taken, with which the empty bottle after having been scanned can be returned into the intake chamber.

In order to accomplish this, it is suggested according to a preferred embodiment of the invention that the transverse slide has a platform for receiving the empty bottle placed into the intake chamber, which bottle can be moved with the transverse slide over the path of movement to the aperture or can be introduced through said aperture into the empty bottle store and can be returned into its initial position after the transfer of the empty bottle. A motor-driven bottle-removing means arranged in the area of the aperture or on the transverse slide for the empty bottle arranged on the platform is hereby advantageously additionally provided, which has a drive motor, which can be operated by the control mechanism in accordance with an output signal of the bottle-recognizing mechanism. The bottle-removing means is hereby only operated when a permissible and/or refundable bottle is announced at the control mechanism by the bottle-recognizing mechanism. A not permitted empty bottle is, without operation of the bottle-removing means, returned into the intake chamber, whereby it is at the same time signalled that an intake of this bottle is not possible.

The bottle-removing means can at the same time be designed as a closure door for the aperture. It is furthermore advantageous to define the intake chamber in the open state with a partition wall toward the side of the aperture and of the sensors, which partition wall can be moved perpendicularly with respect to the direction of movement of the transverse slide. This partition wall is advantageously rigidly connected to the removing means and can be moved together with same. A transverse slide-fixed, vertical sidewall defining the intake chamber is advantageously provided on the transverse slide or on the platform on the side opposite the aperture.

In order to avoid a falling over of the empty bottle when it is placed into the intake chamber, the intake chamber can be defined by a housing-fixed rearward stop wall for the empty bottles. A further improvement of the exactness in the position of the empty bottle in the intake chamber is achieved such that the placement surface of the intake chamber is defined by a housing-fixed front and rearward boundary plate.

The placement surface within the intake chamber is, according to a further advantageous development of the invention, designed as a scale, which has a pressure sensor connected to the control mechanism on the output side. Thus, it is possible to make the weight of the bottle available as a further bottle-recognizing characteristic equal in value to the contour characteristics, with which full bottles and empty bottles and bottles having approximately the same contour, however, different weight, can be separated. The pressure sensor can thereby be designed as a pressure-sensitive resistor or condenser. It is advantageously arranged in a RC-element of an integrator circuit, the output signal of which can be converted through a threshold-value switch or a comparator into a square wave signal with a weight-dependent impulse duration.

A particularly simple and quick bottle exchange is achieved by arranging the empty bottle store in a carriage, which can be moved into a store chamber of the housing. A further improvement in this respect is achieved when the housing has at least two intake chambers arranged one above the other and each being equipped with a sensor slide and a transverse slide, and the carriage has a corresponding number of empty bottle stores arranged one above the other, whereby the store floors of the empty bottle stores are, when the carriage is placed into the store chamber, in alignment with the placement surfaces of the associated intake chambers. The latter is made possible by guide or support rollers being provided on the carriage and/or on the housing, which guide or support rollers are arranged at least on one side on the side of the intake chambers, and through which rollers the carriage can be lifted when moving into the store chamber with its rollers from the floor into a defined position within the housing.

The store floors have advantageously an essentially rectangular boundary edge as a stop for the empty bottles. To signal a full condition, it is possible to arrange in the boundary edge area opposite the aperture, a preferably housing-fixed sensor element reacting to an empty bottle moved thereon, which sensor element can be designed, for example, as a lever pivotal about a vertical axis, which lever carries a reflector arranged in the beam path of a reflecting light barrier or operates a microswitch.

BRIEF DESCRIPTION OF THE DRAWING

The invention will be discussed in greater detail hereinafter in connection with one exemplary embodiment schematically illustrated in the drawings, in which.

DETAILED DESCRIPTION

Figure 1:
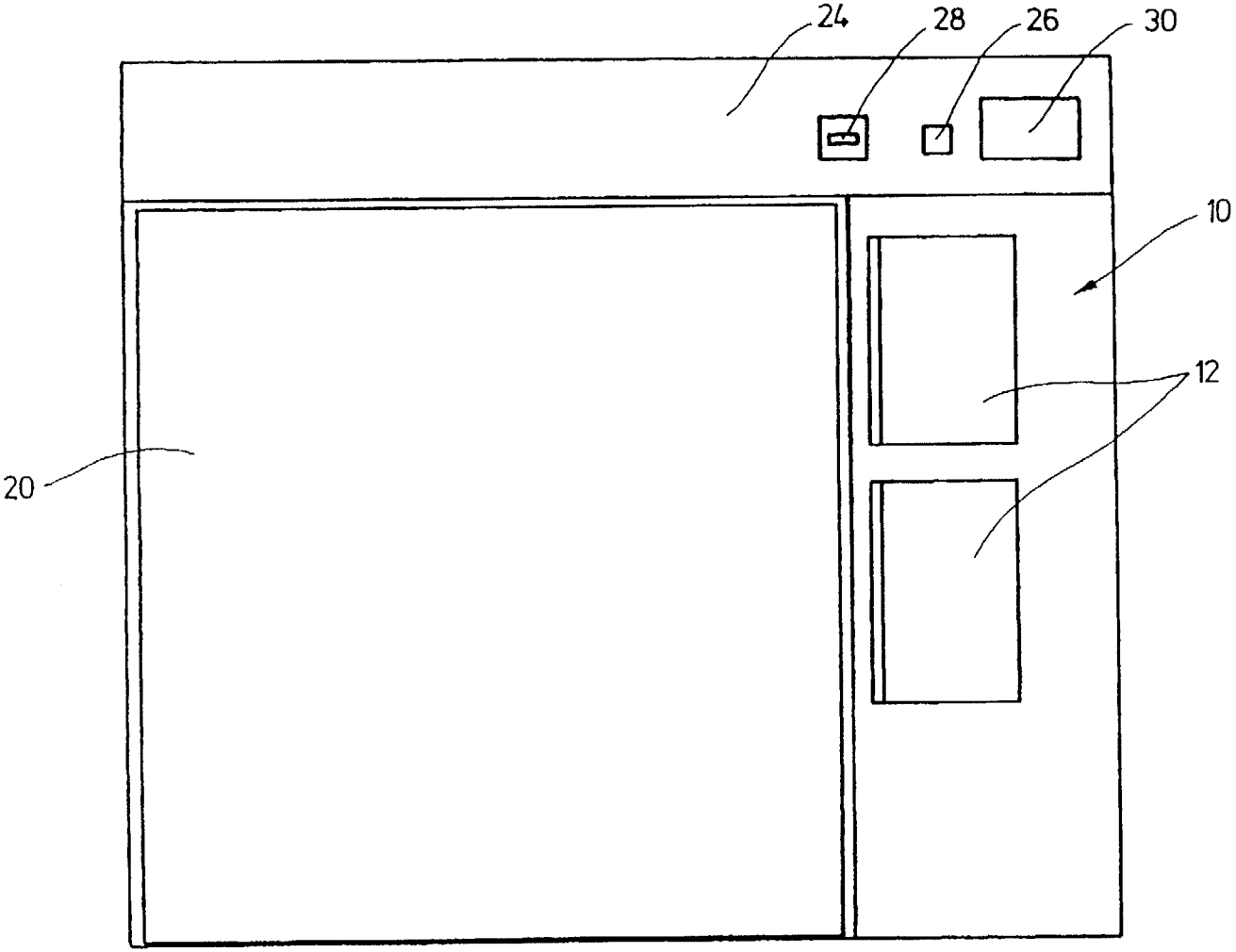
FIG. 1 is a front view of a closed empty bottle collector.
Figure 2:
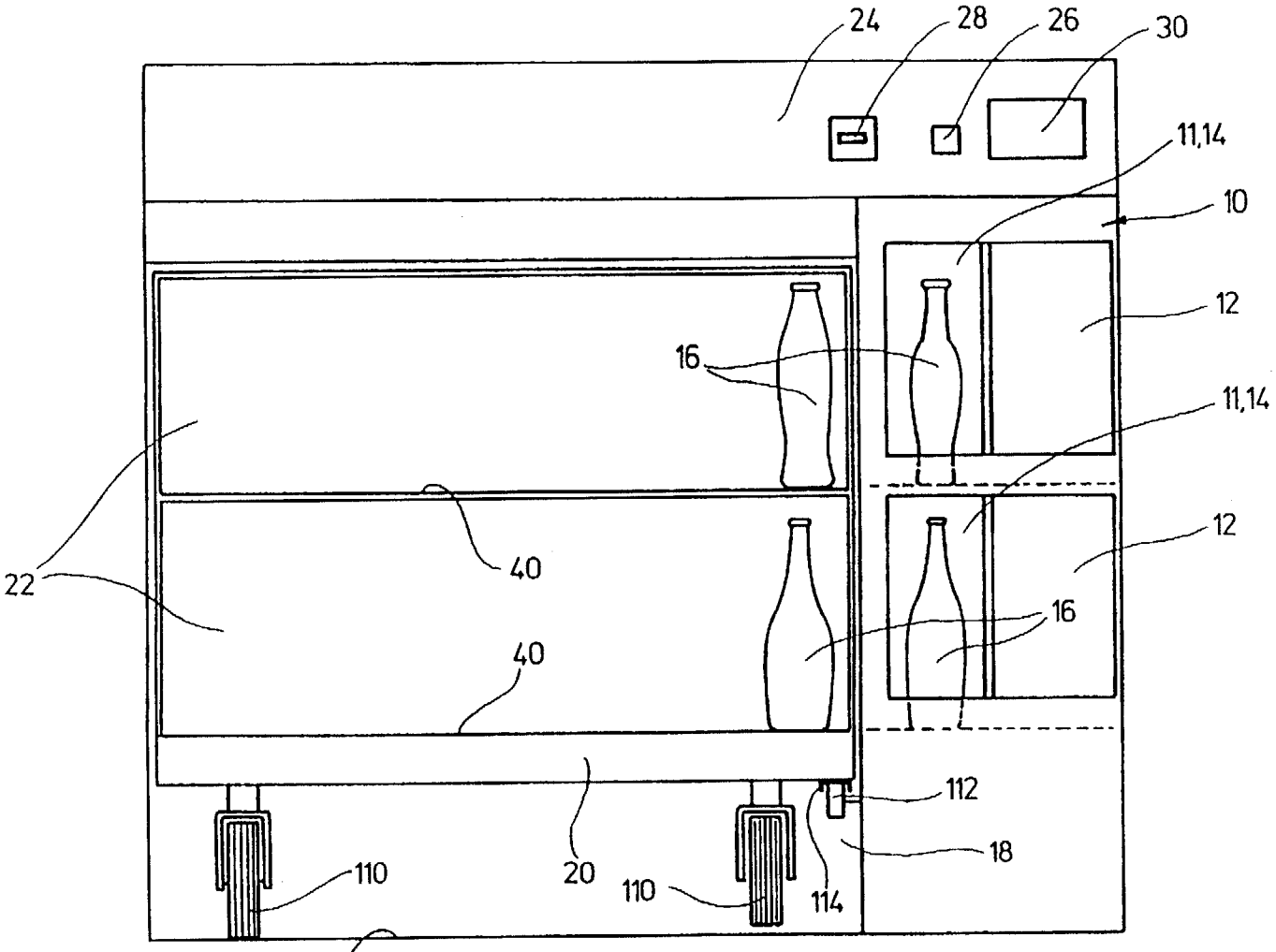
FIG. 2 is a front view of the empty bottle collector with the carriage shield having been removed.

The empty bottle collector illustrated in the drawings consists essentially of a housing 10, two intake chambers 14 for upright positioned empty bottles 16, which chambers are arranged one above the other in the housing, and are each closeable at an intake opening 11 by a sliding door 12, a carriage 20 with two empty bottle stores 22 arranged one above the other, which carriage can be placed into a forwardly open store chamber 18 of the housing, and a control panel 24 with a ticket key 26, a bottle refund ticket output 28, and a display 30.

Figure 3:
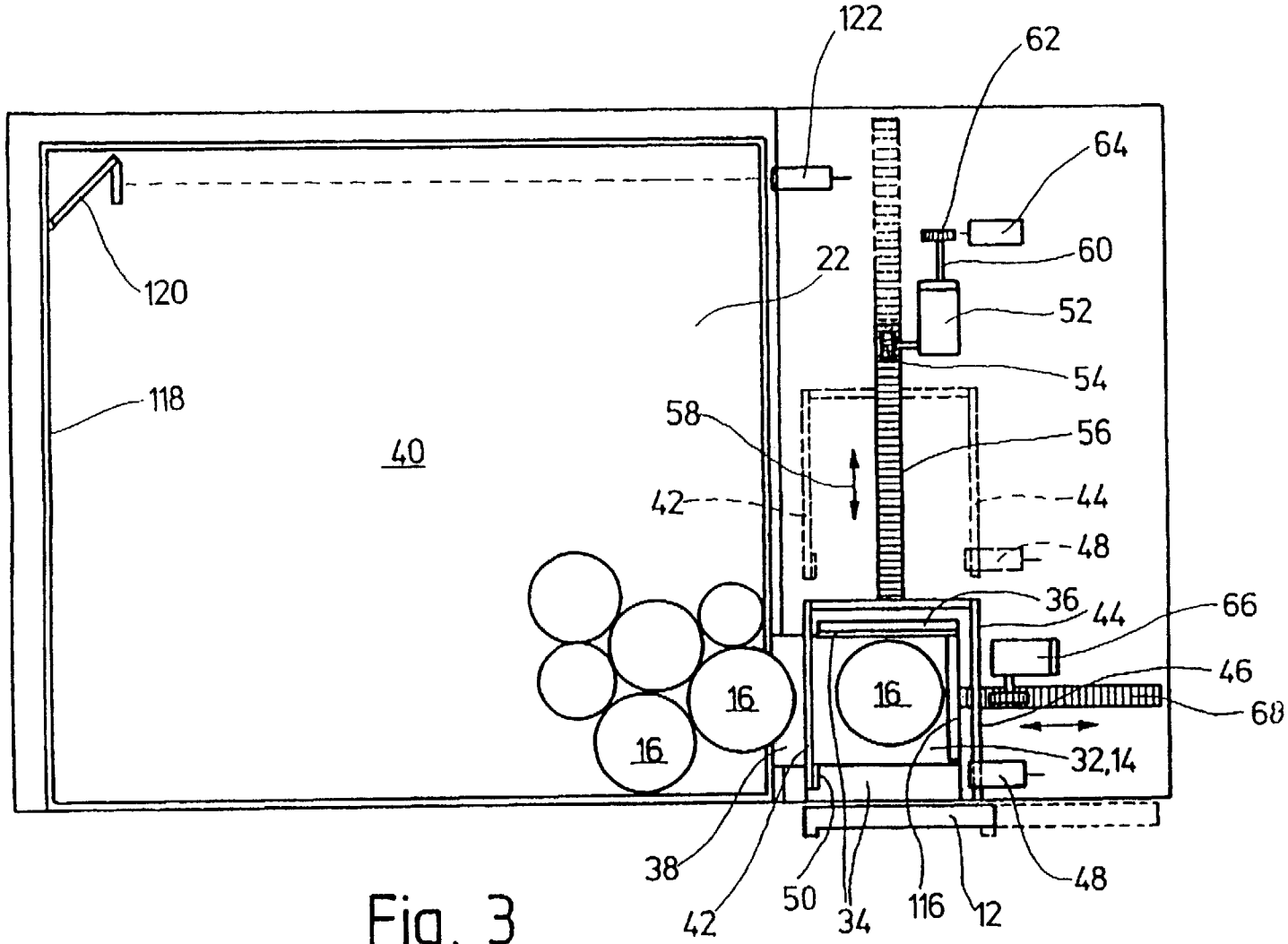
FIG. 3 is a top view of the empty bottle collector with the upper part of the housing having been removed.

The stationary intake chambers 14 in the exemplary embodiment according to FIG. 3 have a housing-fixed placement surface 32, which is defined in forward and rearward direction by an adjusting plate 34 and one rearward stop wall 36. The placement surface 32 of the intake chambers 14 is connected to the adjacent empty bottle store 22 of the carriage 20 through an aperture 38, and is aligned with its store floor 40. The aperture 38 can be closed off by the arm 42 of the sensor slide 44, which arm is at the same time designed as a sliding door. An arm 46 of the sensor slide, which arm is opposite the first arm 42, carries several sensors 48 near its front end, which sensors are designed as optoelectronic transceivers and form together with the mirrors 50 on the arm 42 reflecting light barriers for scanning the contour of the bottles. The sensor slide 44 can be moved back and forth horizontally in direction of the double arrow 58 between a front intake position illustrated in full lines and a rearward end position illustrated in dashed lines with the help of a geared motor 52, a gear 54 and a rack 56. The empty bottle 16 remains on its placement surface 32 in the intake chamber 14 during movement of the sensor slide 44. The sensors 48 move past the bottle along the path of movement and scan its diameter at various heights above the placement surface 32. The geared motor 52 furthermore drives with its driven shaft 60 an incremental distance sensor designed as a gear 62 of a magnetizable material, and a magnetic probe 64, which distance sensor in cooperation with the sensors 48 contributes to recognizing the bottles. The sliding door arm 42 of the sensor slide 44 releases the aperture 38 at the rearward end position. The empty bottle 16, which is in the intake chamber 14, can at this end position be pushed through the aperture 38 into the empty bottle store 22 with the help of the transverse slide 68, which is driven by a motor 66 and which crosses the path of movement of the sensor slide 44 in the area of the intake chamber 14.

The intake chamber 14 is defined, when the transverse slide 68 is pulled back, in the lower part by a slide stamp 116, whereas it is defined in the upper part either by a housing-fixed or by a sensor-slide-fixed boundary wall. Not illustrated sensor shields for the penetration of the sensor light are necessarily recessed in the stamp 116 and in the boundary wall thereabove.

Since the rollers 110 of the carriage 20, which rollers stand on the floor 108, are subjected to a slow wear, precautions must be taken, which guarantee a wear-independent alignment between the placement surfaces 32 of the intake chambers 14, on the one hand, and the store floors 40 of the carriage 20, on the other hand, with the carriage 20 moved into the store chamber 18. Support rollers 112 engaging the store chamber 18 are for this purpose provided on the side of the intake chambers 14, onto which support rollers the undercarriage 20 runs on with a guide groove 114 when being moved into the store chamber 18 by lifting off the rollers 110 nearest the side of the intake chambers.

Figure 4:
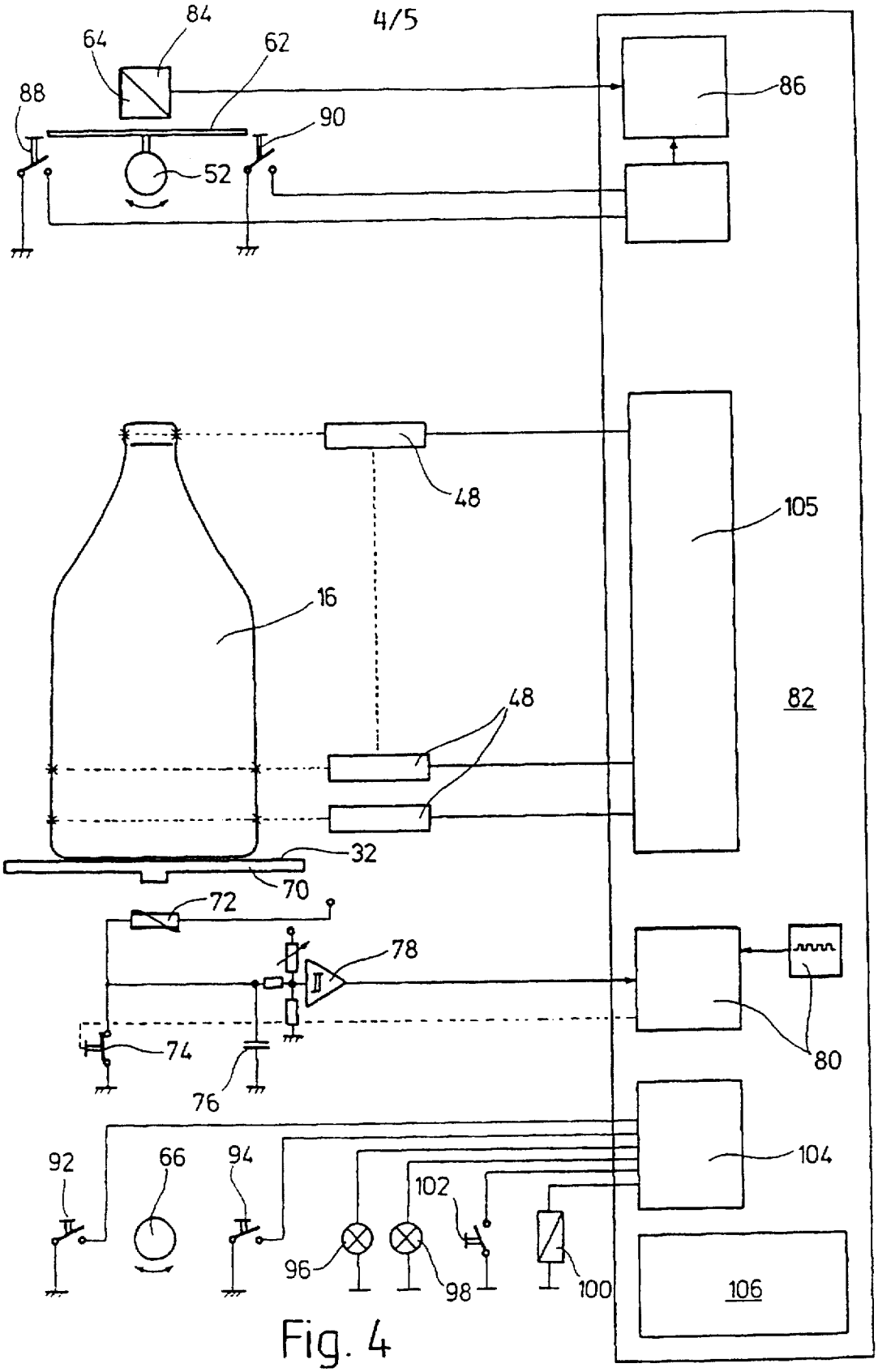
FIG. 4 is a diagram of the bottle-sorting mechanism.

The placement surface 32 of the intake chamber 14 is designed as the surface of a scale 70, which acts with its underside against a pressure-dependent resistor 72. The resistor 72 forms together with a condenser 76, bridgeable by a switch 74, an integrator circuit, which is closed off by a comparator 78. A square wave signal can be read at the output of the comparator 78, the impulse duration of which signal forms, after opening of the switch 74 through the pressure-dependent resistor 72, a measurement for the weight of the bottles. The output signal of the comparator 78 is evaluated in a timing member 80 of the microprocessor circuit 82 by forming comparison values for recognizing the weight. A relative movement between the sensor slide 44 and the sensors 48 arranged thereon on the one side and the empty bottle 16 in the intake chamber 14 on the other side, and thus a contour-recognizing operation is subsequently started through the geared motor 52. Important for the contour of the empty bottle 16 are the diameters in the various measuring planes of the sensors 48, whereby for determining the respective diameter the entering and exiting points are utilized. As can be seen in FIG. 4, the counting signal, which is transformed in the impulse former 84 of the incremental path indicator 62, 64, is applied to the counting input of a counter 86 integrated in the microprocessor 82, whereby the start and the end of the counting operation is determined by the limit switches 88, 90.

Furthermore, the release switches 92, 94 for the transverse-slide drive 66, 68, the signal lamps 96, 98, the locking magnet 100 for the sliding door 12 and the switch 102 can be controlled through output ports 104 of the microprocessor circuit 82. The state of the input ports 80, 86, 105 is cyclically scanned through a microprocessor program. The scanning cycle corresponds thereby with the program-cycle frequency, which in every case must be chosen to be greater than the counting frequency of the path indicator 62, 64.

The evaluation of the arriving signals is done through a software program stored in the memory 106 of the microprocessor 82 using reference value sets also stored in a portion of the memory 106.

Figure 5:
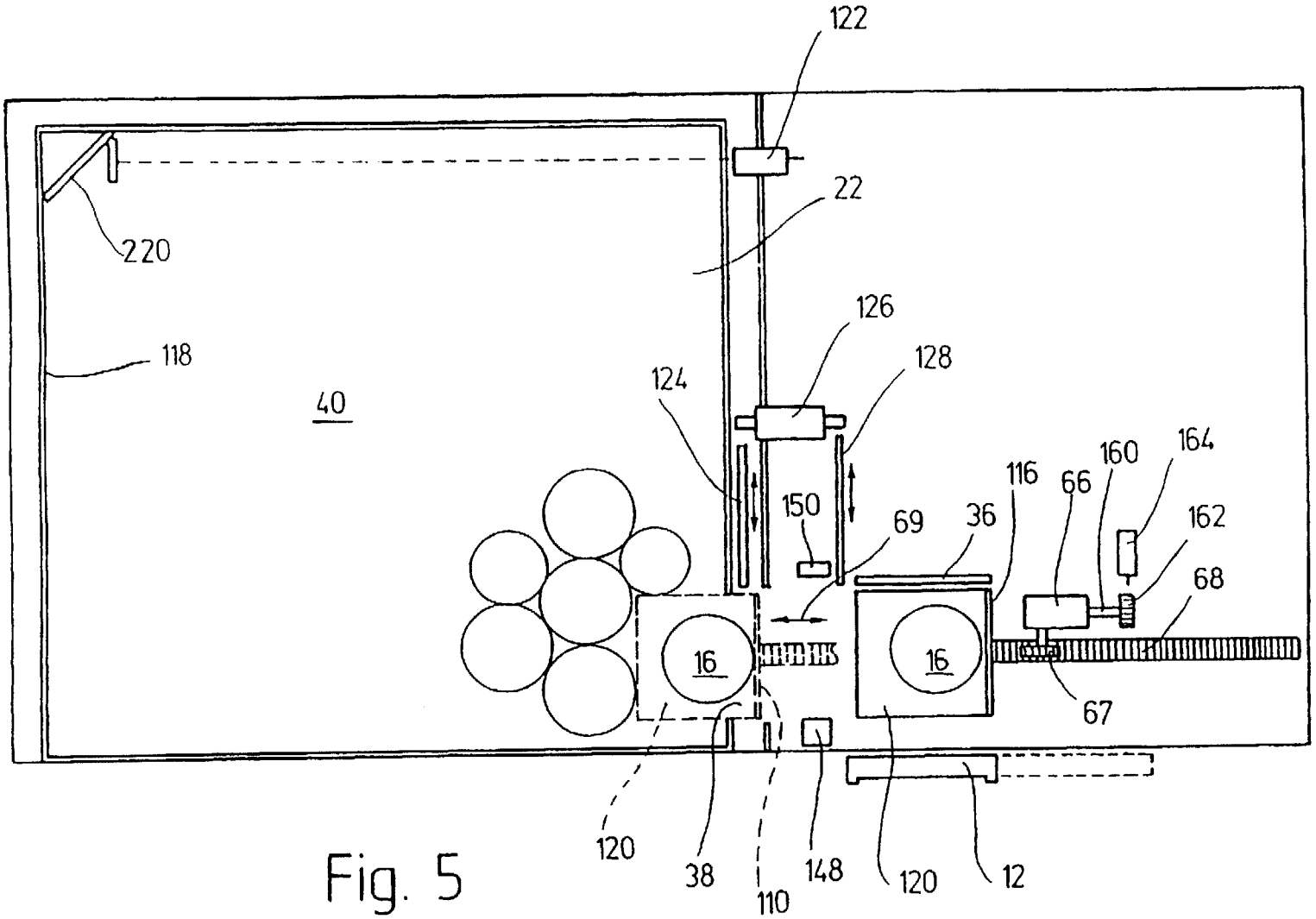
FIG. 5 is an illustration corresponding with FIG. 3 for a modified exemplary embodiment of an empty bottle collector.

The exemplary embodiment according to FIG. 5 differs from the one according to FIG. 3, mainly in the sensors 148 designed as optoelectronic transceivers and their mirrors 50 being arranged housing-fixed in the area of the path of movement of the transverse slide 68 such that the sensor slide 44 is not needed. The transverse slide 68 can be moved back and forth horizontally in direction of the double arrow 69 between a rearward intake position illustrated in full lines and a forward position illustrated in dashed lines with the help of the geared motor 66, a gear 67 and a rack 68. The geared motor 66 furthermore drives with its driven shaft 160 an incremental distance sensor designed as a gear 162 of a magnetizable material, and a magnetic probe 164, which distance sensor in cooperation with the sensors 148 contributes to recognize the bottles. The transverse slide 68 has a slide-fixed platform 120, which is used as the placement surface for the empty bottle 16. A slide-fixed boundary wall 116 is provided toward the side of the driving motor 66, whereas the rear wall 36 of the intake chamber is arranged fixed on the housing. The platform 120 moves with the bottle 16 provided on it along the path of movement through the aperture 38 into the empty bottle store 22, and is scanned without contact along the path of movement by the sensors 148 in order to recognize the bottle. The actual transfer of the empty bottle 16 into the empty bottle store 22 is done by a wiping means 124, which, with the transverse slide 116 being moved out, is moved with the help of a driving motor 126 over the platform 120 into the aperture opening 38, so that during the subsequent pulling back of the transverse slide 116, the empty bottle 16 is wiped off from the platform 120. The bottle wiping means 124 is, in this exemplary embodiment, used at the same time as a closure door for the aperture 42. In order to prevent, when the intake chamber 14 is open, a passage to the sensors 148 and to the aperture 38, a partition wall 128 is additionally provided, which can be rigidly connected to the wiping means 124 and can be moved together with said wiping means.

The store floors 40 have an essentially rectangular boundary edge 118, which in the illustrated exemplary embodiments is formed by the vertical outer walls of the carriage 20. The apertures 38 are formed by a wall opening in the wall area of the carriage 20 on an intake side, which are automatically closed by the action of a spring (not illustrated) when the carriage is removed from the store chamber 18.

As soon as one of the store floors 40 is full, the reflection light barrier 122 or a microswitch is triggered by the housing-fixed sensor element 220 operated by an empty bottle 16 having been set down issuing a "full" signal and the sliding door 12 of the respective intake chamber 14 is blocked. Thus only the other intake chamber 14 can still be supplied with empty bottles until its empty bottle store 22 is also full. Further operation is then only possible when the carriage 20 with the full bottle stores 22 is replaced with one with empty stores. In order to guarantee an easy mobility, the carriage 20 has relatively large travelling rollers 110. To empty the carriage, the bottles 16 are initially removed fromabove from the upper store floor 40, and, if desired, are sorted into available bottle boxes. To empty the lower store floor 40, the earlier emptied upper store floor 40 is, for example, tilted upwardly at a hinge joint in order to be able to freely access from above the respective bottles 16.

In conclusion the following is to be said: The invention relates to an empty bottle collector having an intake chamber 14 for empty bottles 16 and a carriage 20 as an interchangeable store 22. In order to guarantee a simple handling during the feeding and emptying of the interchangeable store 22, the empty bottle store 22 is accessible from the stationary intake chamber 14 through a closable aperture 38, which is aligned transversely with respect to the intake opening 11. Furthermore, a feeding mechanism is provided, which has a transverse slide 68, which can be moved back and forth transversely with respect to the intake direction through the intake chamber 14, in direction of the aperture 38. The bottles are recognized by a sensor slide 44, which is moved back and forth in intake direction within the housing 10 and crosses the path of movement of the transverse slide 68 in the area of the intake chamber, and which sensor slide has sensors 48 for the contactless scanning of the bottle contour.

The embodiments of the invention in which an exclusive property or privilege is claimed are defined as follows:

1. In an empty bottle collector comprising a housing, at least one intake chamber for empty bottles accessible from outside through a closeable intake opening, the intake chamber being adapted to receive empty bottles in an intake direction through the intake opening, an empty bottle store following the intake chamber, a feeding mechanism having a bottle slide which is extendable and retractable through the intake chamber to effect movement of an inserted empty bottle on a linear path of movement toward the empty-bottle store, a bottle recognition mechanism provided in the area of the intake chamber for recognizing the bottles, the bottle recognition mechanism having a sensor slide linearly movable within the housing and crosses the path of movement of the bottle slide in the area of the intake chamber, the sensor slide being equipped with a sensor for scanning at least one of the bottle contour and the bottle diameter and producing corresponding output signals, and a control mechanism receiving the output signals of the bottle recognition mechanism for controlling the feeding mechanism, the intake chamber having a placement surface for receiving an upright positioned empty bottle and the empty bottle store having a store floor at the level of the placement surface for receiving upright positioned empty bottles, the improvement wherein the empty bottle store is accessible from the stationary intake chamber through a closeable aperture aligned transversely with respect to the intake opening, wherein the bottle slide is movable transversely with respect to the intake direction, wherein the sensor slide is equipped with sensors for the contactless scanning of at least one of the bottle contour and the bottle diameter, and wherein a drive coupled to the sensor slide for moving the sensor slide is coupled with a path distance indicator operating with the sensors for recognizing the bottle.

2. The empty bottle collector according to claim 1, wherein the sensor slide has a lateral arm, the lateral arm being adapted to be a closure door for the aperture.

3. The empty bottle collector according to claim 2, wherein the sensor slide has a second arm carrying the sensors alone a side of the intake chamber opposite the lateral arm.

4. The empty bottle collector according to claim 3, wherein a housing-fixed lateral boundary wall is positioned in the intake chamber adjacent the second arm.

5. The empty bottle collector according to claim 4, wherein the lateral boundary wall has sensor shields elongated in the direction of movement of the sensor slide.

6. The empty bottle collector according to claim 4, wherein at least one of the lateral housing-fixed boundary wall and the sensor slide arm opposite the closure door has a recess for passage of the bottle slide in a lower area adjacent to the placement surface.

7. The empty bottle collector according to claim 6, wherein a front surface of the transverse slide forms, in an end position moved remote from the aperture, a lower part of the lateral boundary wall of the intake chamber.

8. An empty bottle collector comprising a housing, at least one intake chamber accessible from outside through a closeable intake opening for intaking empty bottles in an intake direction, an empty bottle store following the intake chamber, a feeding mechanism having a bottle slide extendable and retractable through the intake chamber for moving an inserted empty bottle toward the empty bottle store on a linear path of movement, a bottle recognition mechanism provided in the area of the intake chamber for recognizing the bottles and producing output signals, and a control mechanism receiving the output signals of the bottle recognition mechanism for controlling the feeding mechanism, the intake chamber having a placement surface for receiving an upright positioned empty bottle, the empty bottle store having a store floor provided at the level of the placement surface for receiving upright positioned empty bottles, wherein the empty bottle store is accessible from the intake chamber through an aperture aligned transversely with respect to the intake opening, wherein the bottle slide has a transverse slide movable transversely with respect to the intake direction, wherein the bottle recognition mechanism has in the area of the path of movement between the intake chamber and the aperture sensors arranged fixedly on the housing for contactless bottle scanning and for bottle recognition, and wherein a distance sensor is connected to the transverse slide for recognizing the bottles, and the distance sensor operates with the sensors to recognize bottles.

9. The empty bottle collector according to claim 8, wherein the intake chamber is defined by a housing-fixed rearward stop wall for the empty bottles.

10. The empty bottle collector according to claim 9, wherein the placement surface of the intake chamber is defined by a housing-fixed front and rearward boundary plates.

11. The empty bottle collector according to claim 10, wherein the sensors are designed as optoelectronic scanning members.

12. The empty bottle collector according to claim 8, wherein the placement surface has, within the intake chamber, a scale connected to the control mechanism on an output side.

13. The empty bottle collector according to claim 12, wherein the scale has a scale plate with a pressure sensor, the pressure sensor being one of a pressure-sensitive resistor and a condenser.

14. The empty bottle collector according to claim 13, wherein the pressure sensor is in a RC-element of an integrator circuit, an output signal of the integrator circuit being converted into a square-wave impulse with an impulse duration dependent on the weight of the bottles through one of a threshold-value switch and a comparator.

15. The empty bottle collector according to claim 8, wherein the transverse slide has a platform for receiving the empty bottle placed into the intake chamber, the platform being an initial position for the empty bottle, the empty bottle being moved by the transverse slide over the path of movement to the aperture and the bottle recognition mechanism has means for determining if the empty bottle is received in the empty bottle store and if the determining means rejects the empty bottle, the empty bottle returns to the initial position.

16. The empty bottle collector according to claim 15, wherein a bottle-removing means is arranged in the area of the aperture for engaging the empty bottle arranged on the platform to move the empty bottle into the empty bottle store.

17. The empty bottle collector according to claim 16, wherein the bottle-removing means is a closure door for the aperture.

18. The empty bottle collector according to claim 15, wherein the transverse slide has a bottle-removing means for moving the empty bottle from the platform into the empty bottle store.

19. The empty bottle collector according to claim 16, wherein the bottle-removing means has a drive motor operated by the control mechanism in response to an output signal of the bottle-recognizing mechanism.

20. The empty bottle collector according to claim 15, wherein the platform has a vertical sidewall fixed on the transverse slide and partly defines the intake chamber on a side opposite the aperture.

21. The empty bottle collector according to claim 15, wherein a partition wall defines the intake chamber toward the side of the aperture and of the sensors, the partition wall being movable perpendicularly with respect to the direction of movement of the transverse slide.

22. The empty bottle collector according to claim 21, wherein the partition wall is rigidly connected to the bottle-removing means and is moved together with the bottle-removinq means.

23. The empty bottle collector according to claim 18, wherein the empty bottle store is arranged in a carriage movable into a store chamber in the housing.

24. The empty bottle collector according to claim 23, wherein guide rollers are arranged on one of the carriage and the housing at least on one side of the intake chamber, the rollers effecting a lifting of the carriage when moving the carriage into the store chamber into a defined position within the housing.

25. An empty bottle collector comprising a housing including a store chamber, at least one intake chamber for receiving empty bottles in an intake direction, the intake chamber being accessible from outside through a closable intake aperture, an empty bottle store following the intake chamber, a motor-drivable feeding mechanism for the transport of individual empty bottles from the intake chamber into the empty bottle store, a bottle recognition mechanism provided in the area of the intake chamber for recognizing the bottles and producing corresponding output signals, and a control mechanism reacting to output signals of the bottle recognition mechanism for controlling the feeding mechanism, the intake chamber having a placement surface for receiving an upright positioned empty bottle, the empty bottle store having a store floor provided at the level of the placement surface for receiving upright positioned empty bottles, the empty bottle store being arranged in a wheeled carriage, the wheeled carriage being movable into and out of the store chamber, housing support rollers arranged on one of the wheeled carriage and the housing, the rollers being arranged adjacent the intake chamber, the rollers effecting a lifting of the carriage from a floor when moving the wheeled carriage into the store chamber with the wheels on the carriage being at a defined position within the housing.

26. The empty bottle collector according to claim 25, wherein the housing has at least two intake chambers arranged one above the other and each equipped with at least one of a sensor slide and a transverse slide, and wherein the wheeled carriage has a corresponding number of empty bottle stores arranged one above the other, the store floors of the empty bottle stores being aligned with the placement surfaces of the associated intake chambers when the wheeled carriage is positioned in the store chamber.

27. The empty bottle collector according to claim 26, wherein the store floors have an essentially rectangular boundary edge formed by vertical carriage walls, and wherein a housing-fixed sensor element reacting to the empty bottle moved thereon is arranged in the boundary edge area opposite the aperture.

28. The empty bottle collector according to claim 27, wherein the sensor element is a lever pivotal about a vertical axis against the force of a spring, the lever has at least one of a reflector and a microswitch, the reflector being positioned in a beam path of a reflecting light barrier.

29. The empty bottle collector according to claim 27, wherein the sensor element is arranged in the area of an edge corner of the store floors, and wherein the aperture at the associated boundary edge is arranged shifted off center in direction toward a diagonally opposite boundary edge corner.

* * * * *

UNITED STATES PATENT AND TRADEMARK OFFICE

CERTIFICATE OF CORRECTION

PATENT NO. : 5,788,045

DATED : August 4, 1998

INVENTOR(S) : Richard STIEFEL, et al.

It is certified that error appears in the above-identified patent and that said Letters Patent is hereby corrected as shown below:

Column 8, line 20; change "alone" to ---along---.

Column 9, line 52; change "15" to ---16---.

line 60; change "removinq" to ---removing---.

Column 10, line 1; change "18" to ---8---.

Signed and Sealed this

Second Day of March, 1999

*Attest:*

*Attesting Officer*

Q. TODD DICKINSON

*Acting Commissioner of Patents and Trademarks*